US006290273B1

(12) United States Patent
Moisan

(10) Patent No.: US 6,290,273 B1
(45) Date of Patent: Sep. 18, 2001

(54) ARTICULATED SNOW SHOVEL

(76) Inventor: Marius Moisan, 4822, rue Legendre, Contrecoeur (CA), J0L 1C0

( * ) Notice: Subject to any disclaimer, the term of this patent is extended or adjusted under 35 U.S.C. 154(b) by 0 days.

(21) Appl. No.: 09/612,505

(22) Filed: Jul. 7, 2000

(51) Int. Cl.[7] ..... E01H 5/02
(52) U.S. Cl. ..... 294/54.5; 294/53.5
(58) Field of Search ..... 294/51, 53.5, 54.5, 294/57; 37/241, 265, 278, 283–285

(56) References Cited

U.S. PATENT DOCUMENTS

| | | | | |
|---|---|---|---|---|
| 813,983 | * | 2/1906 | Luney | 294/54.5 |
| 1,162,845 | * | 12/1915 | Armstrong | 294/53.5 |
| 1,196,206 | * | 8/1916 | Bulger et al. | 294/54.5 X |
| 1,666,334 | * | 4/1928 | Larson | 37/284 |
| 2,098,609 | * | 11/1937 | Bishop | 294/54.5 X |
| 2,239,297 | * | 4/1941 | Allen et al. | 294/53.5 X |
| 2,266,542 | * | 12/1941 | Fox | 37/283 |
| 2,967,363 | * | 1/1961 | Meier | 294/53.5 X |
| 3,078,604 | * | 2/1963 | Neuman | 294/54.5 |
| 3,473,838 | * | 10/1969 | Rankin | 294/53.5 |

FOREIGN PATENT DOCUMENTS

| | | | | |
|---|---|---|---|---|
| 38031 | * | 6/1955 | (PL) | 294/53.5 |

* cited by examiner

*Primary Examiner*—Johnny D. Cherry

(57) ABSTRACT

The present invention concerns a manual snow discarding device that takes into account the security and the efficiency of the snow discarding operation. The device includes at a lower extremity of a shaft an angularly adjustable bent section having a lower end essentially vertically oriented and curved to assume the shape of part of the back of a concave blade, thereby physically increasing the height of a handle at the upper extremity of the shaft for a same angle between the shaft and an horizontal line. The shaft is also secured in place by a securing member, allowing to alternatively position the shaft of the shovel at different angles with respect to the blade depending on the use of the shovel that is to be performed and/or depending on the height of the user. This also enables persons of a large range of height to be able to use the shovel effectively with various angles to be given on the blade.

8 Claims, 4 Drawing Sheets

ARTICULATED SNOW SHOVEL

FIELD OF THE INVENTION

The present invention relates to a manual snow shovel, more specifically to an articulated and adjustable snow shovel.

BACKGROUND OF THE INVENTION

The use of a snow shovel as well as the drawbacks and the risk of accidents accompanying its use are well known in many regions of the world. The snow discarding operation requires significant amount of physical effort not efficiently managed that impact on its security.

Shovels with angularly adjustable handle or adjustable blades to ease these problems have already been disclosed in the prior art in U.S. Pat. No. 2,098,609 issued on Nov. 9, 1937 to Bishop entitled "Shovel with adjustable handle" and U.S. Pat. No. 3,473,838 issued on Oct. 21, 1969 to Rankin entitled "Snow removal device". These two U.S. Patents show snow removal equipment that do not ease the physical effort by requiring a significant bending of user's back and a poor functioning on rough surfaces.

U.S. Pat. No. 4,559,726 issued on Dec. 24, 1985 to Moisan entitled "Snow mover" shows complex pivoting and locking mechanisms of the blade that badly affect its efficiency. U.S. Pat. No. 5,630,633 issued on May 20, 1997 to Dupre et al. entitled "Shovel with driven tiltable blade" discloses a shovel equipment that is primarily made to move a load from one location to another, with a mechanism adapted for frequent changes of the blade angle.

The above-mentioned prior arts all have a pivotable system linking the shaft to the blade, hence allowing to either adjust the blade at various angles in relation with the ground surface and/or positioning the shaft of the shovel at various angles in relation with the user. However, none of those systems has a dual improved design as suggested in this invention.

The previous art often brings the handle of the shaft at a very low vertical position which is not ergonomically designed to relief the strain on the back of a user when the angle between the blade and the shaft is increased. In the same manner, the shovels of the prior art are not designed to help users of different height to equally and safely use the devices.

OBJECTS OF THE INVENTION

It is therefore a general object of the present invention to provide a manually operated snow shovel device of the character described which obviates the above noted disadvantages.

Another object of the present invention is to provide a manually operated snow shovel device that is ergonomically designed to avoid significant bending to the user's back by providing an elevated handle position that also provides a low inclination position of the shaft from horizontal, and consequently a larger angle between the shaft and the plan of the blade of the shovel.

A further object of the present invention is to provide a manually operated snow shovel device that allows a similar use of the shovel to users of different height.

Another object of the present invention is to provide a manually operated snow shovel device that provides a positioning mechanism to put the curved (concave) blade of the shovel at various angles in relation with the ground surface to enhance multiple uses such as snow clearing, scraping, and/or shoveling; the positioning mechanism also provides an enhanced lateral stability of the device.

A further object of the present invention is to provide a manually operated snow shovel device that provides an easier and more ergonomic hand-gripping action on the handle of the shovel.

A further object of the present invention is to provide a manually operated snow shovel device that vertically keeps the users' hands in line with or above the hips of the user at all times.

Yet another object of the present invention is to provide a manually operated snow shovel device that is further adapted, with a T-shaped hand grip, to properly clear snow out of delicate surfaces such as a substantially horizontal house roof or veranda floor, and also efficiently clearing snow out of an exterior ice skating-rink by a user wearing ice skates.

SUMMARY OF THE INVENTION

The present invention is directed to a snow shovel comprising a shaft having a handle member at a first upper extremity and a downwardly oriented bent section at a second lower extremity and defining a substantially vertical plane, a generally concave blade member pivotally mounted at said second extremity of said shaft around an horizontal axis perpendicular to said vertical plane, a securing member providing a plurality of securing positions of said bent section of said shaft to said blade member into different relative angular positions, thereby adjusting a vertical position of said handle member relative to said blade member, said bent section having a lower end essentially vertically oriented and curved to substantially assume a shape of said concave blade member Preferably, the snow shovel further comprises an attachment member to pivotally secure said blade member to said: lower end of said bent section at a pivot axis.

Preferably, the securing member includes an arcuate member rigidly secured at one end to said blade member, said arcuate member being centered around said pivot axis of said attachment member.

Preferably, the arcuate member includes a pair of parallel arcuate strips rigidly secured at one end to said blade member, said two arcuate strips slidably receiving said lower end of said bent suction therebetween and having a plurality of symmetrical perforations therealong, said bent section of said shaft having a transverse through hole consecutively aligning with a pair of said symmetrical perforations under pivotal movement of said attachment member, and a locking pin simultaneously releasably engaging into said transverse hole and one of said pair of symmetrical perforations corresponding to one of said securing positions.

Preferably, the locking pin includes a clamping member to releasably secure the same in locking position.

Preferably, the clamping member is an upper resilient hook clamping to said bent section and maintaining said locking pin in said locking position.

Preferably, the handle member is a T-shaped grip with top transverse bar slightly inclined toward said blade member, thereby providing comfortable position of a user's hands.

BRIEF DESCRIPTION OF THE DRAWINGS

In the annexed drawings, like reference characters indicate like elements throughout.

DETAILED DESCRIPTION OF THE PREFERRED EMBODIMENT

Figure 1:
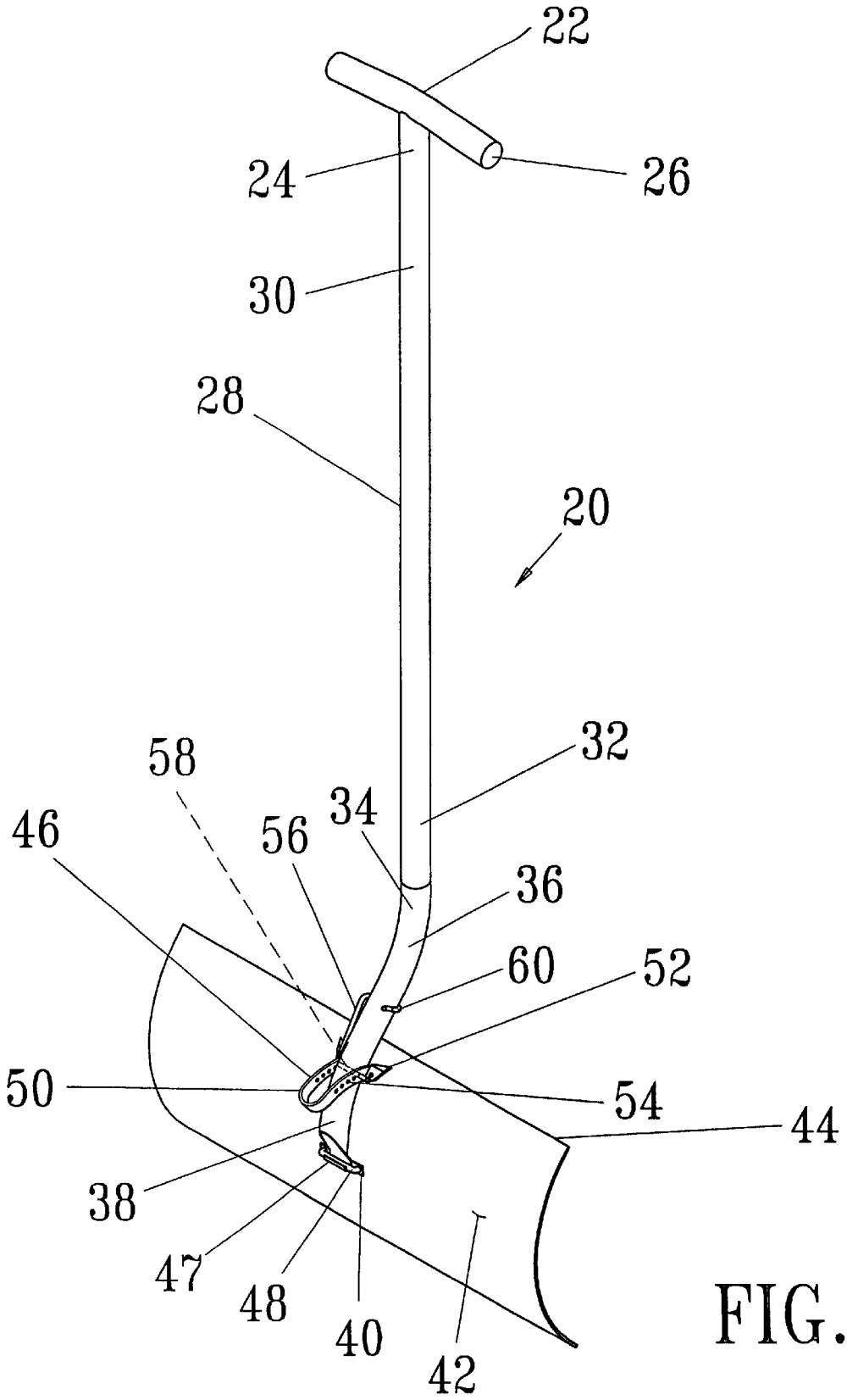
FIG. 1 is a perspective view of an embodiment of a manually operated snow shovel device according to the present invention with a metallic concave blade.

Referring to FIG. 1, there is shown an embodiment of an articulated snow shovel device 20 according to the present invention with a handle member 22 secured at the upper extremity of a shaft 28. The handle 22 in this case is a T-shaped hand grip 24 where the top transverse bar 26 is slightly inclined toward the lower part of the shovel 20 when the latter is used to push snow S (shown on FIG. 3) for example. A downwardly oriented bent section 36 forms the lower extremity 32 of the shaft 28. The bent section 36 is pivotally secured by an attachment member 40 to the back 42 (convex side) of a blade member, preferably a generally concave blade 44. A securing member 46 holds the bent section 36 of the shaft 28 in a selected angular securing position (better shown on FIGS. 2 and 3) relative to the blade 44.

Figure 2:
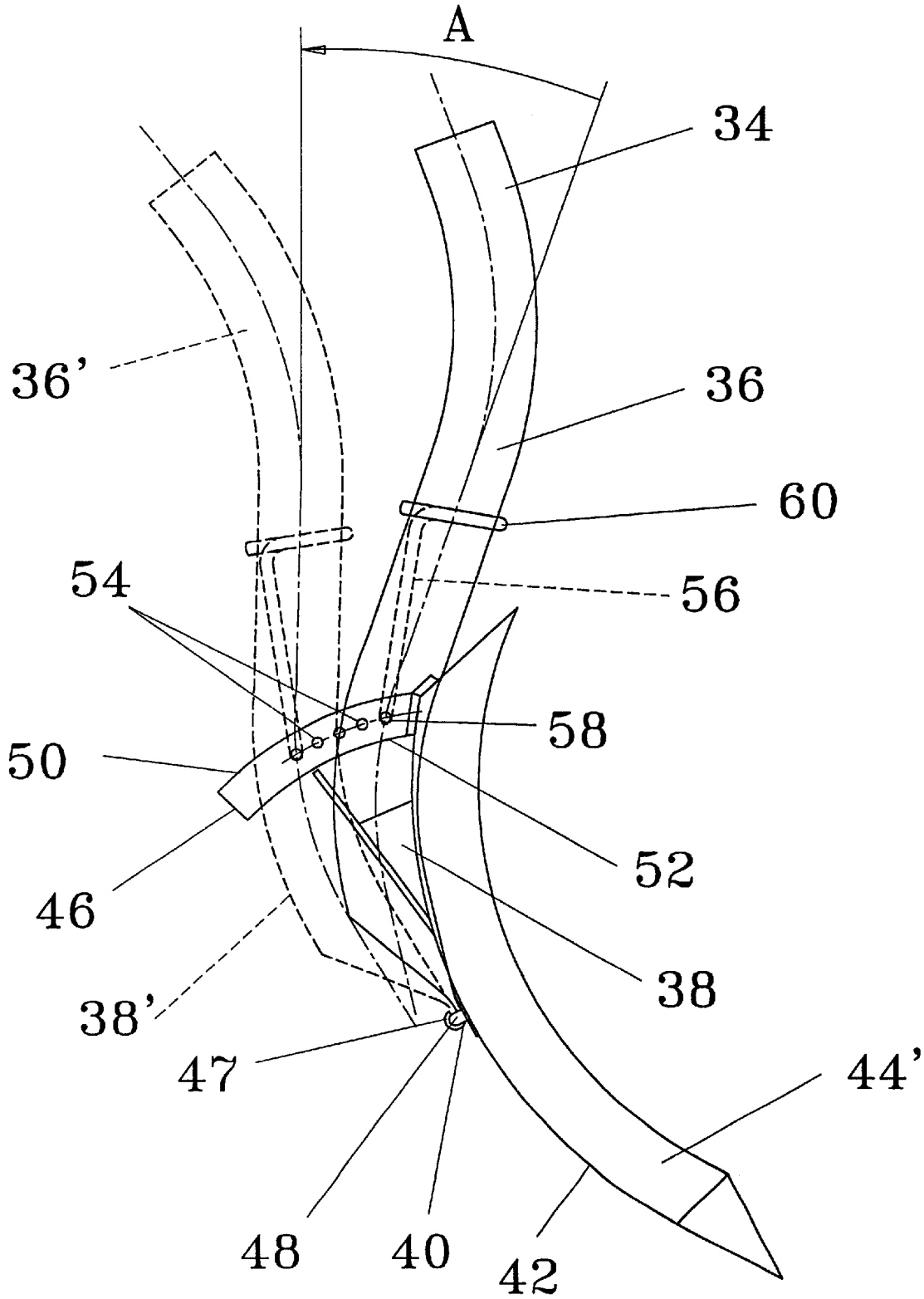
FIG. 2 is an enlarged side elevation view showing the two limit angular positions of the bent section with respect to the blade of the embodiment of FIG. 1*a*.
Figure 3:
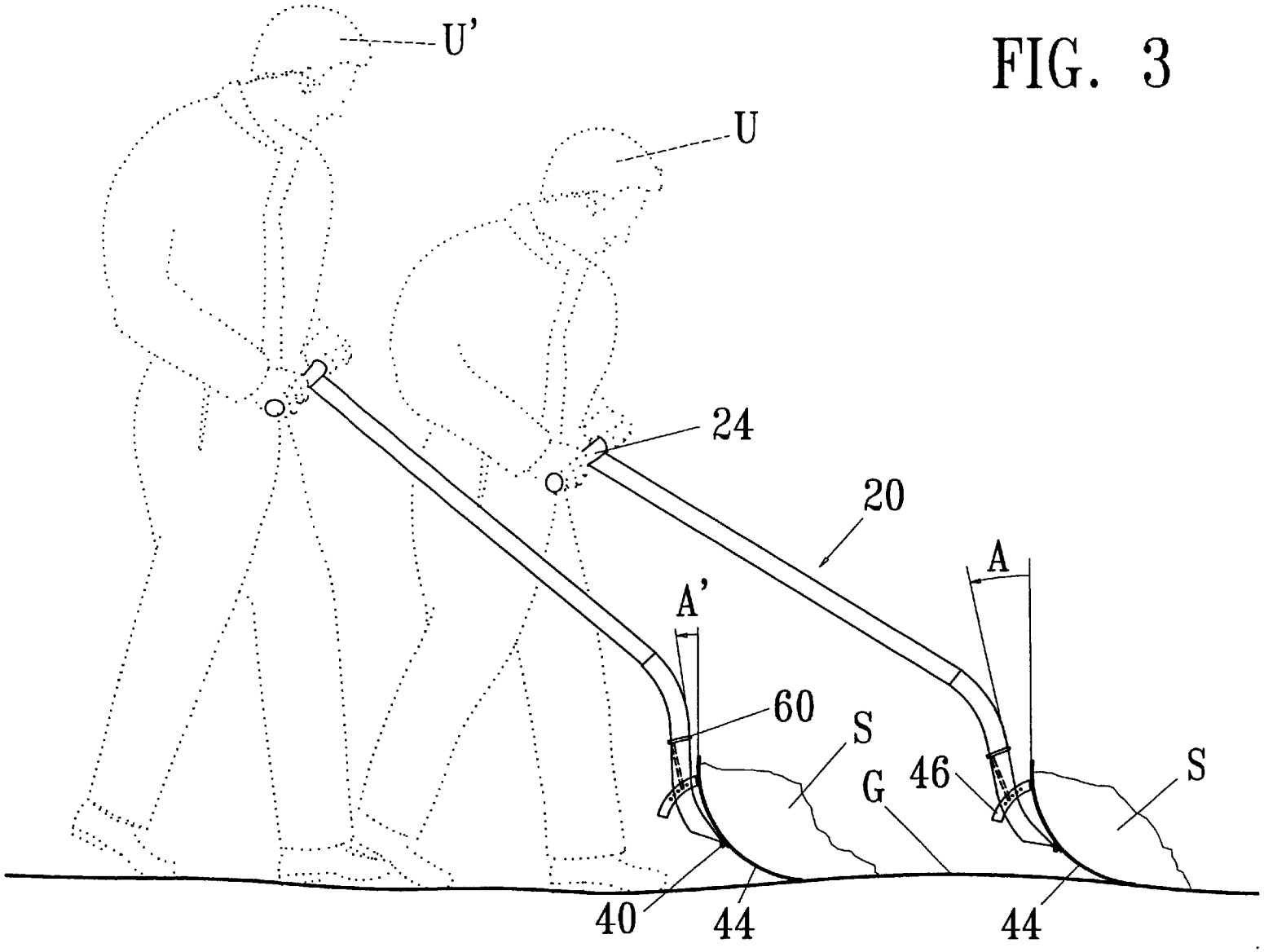
FIG. 3 is side elevation view of the embodiment of FIG. 1 showing two different uses of a same embodiment of the invention with two different angular positions.

The attachment member 40 preferably consists of a C-shaped hook member 47 at the lower end 38 of the bent section 36 fixing itself around a horizontal bar 48 determining a pivot axis and secured on the back 42 of the blade 44 to allow the bent section 36 and the shaft 28 to pivotally move in relation to the blade 44 as per the selected angular securing position A (see FIGS. 2 and 3).

The securing member 46 preferably consists of a generally concave U-shaped arcuate bracket 50, curved around the pivot axis of the attachment member 40, where the free ends of the two arcuate arms 52 (or strips) are secured on the back 42 of the blade 44 above the attachment member 40. The two arcuate arms 52 have a plurality of symmetrical perforations 54 adapted to receive a locking pin 56 to secure the bent pipe 36 in the selected angular securing position A. The two arms 52 of the U-shaped bracket 50 are arcuate in shape as to allow for a transversal through hole 58 of the bent section 36 to be aligned with any pair of symmetrical perforations 54 of the arms 52 having the bent section 36 located therebetween when the latter pivotally moves around the horizontal bar 48. The locking pin 56 is then releasably engaged into the selected pair of symmetrical perforations 54 of the U-shaped bracket 50 and the aligned transverse perforation 58 of the bent section 36 to secure the latter and the shaft 28 in the selected angular securing position A relative to the blade 44. The locking pin 56 preferably includes a clamping member, preferably an upper resilient hook section 60, adapted to clamp around the bent section 36 and releasably secure the locking pin 56 in its locking position.

The arc shape of the bracket 50 combined with the bent shape of the lower extremity 32 of the shaft 28 offers enhanced lateral stability at the handle 22 and, at the same time, raises the handle 22 to reduce the bending effort of the user.

Figure 1A:
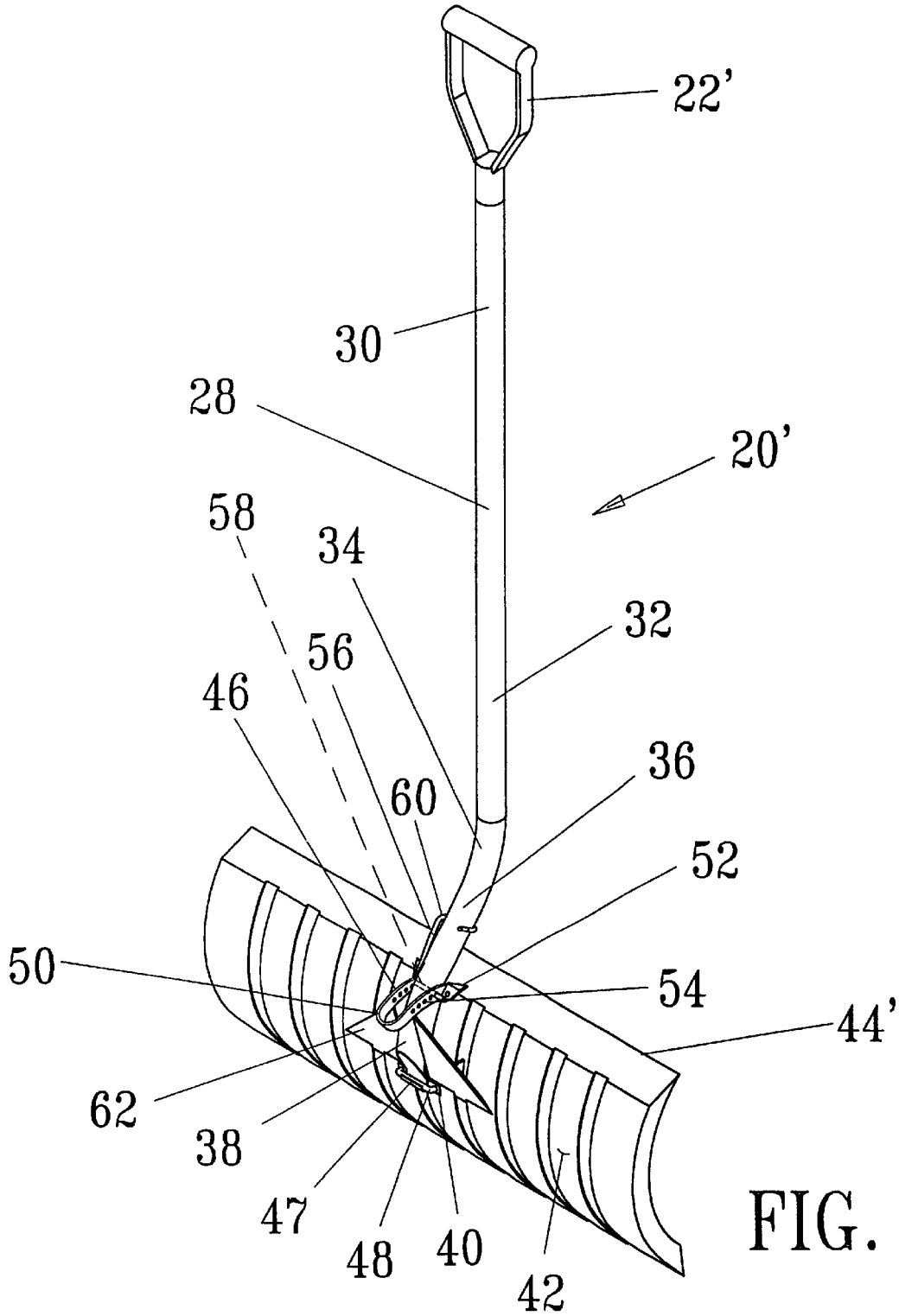
FIG. 1*a* is a perspective view of a second embodiment of a manually operated snow shovel device with a different handle and a plastic concave blade.

FIG. 1*a* shows a second embodiment 20' similar to the first embodiment 20 of FIG. 1. The shovel 20' is adapted with a more conventional type of handle 22' which is of a better suited use in case the device 20' is used to lift the snow S as opposed to having a T-shaped grip 24 more appropriate to push the snow S as in FIGS. 1 and 3. The one-hand handle 22' is also well suited for light shovels 20 with narrower blades 44. The blade 44' can be alternatively made out of a strong resilient thermoplastic (See FIGS. 1*a* and 2) as opposed to an alloy compound or aluminum such as shown in FIGS. 1 and 3. With the plastic blade 44', preferably triangular reinforcing plates 62 on the back 42 of the blade 44' are usually required in the surroundings of the attachment 40 and securing 46 members to provide sufficient rigidity and stiffness to the blade 44'.

FIG. 2 shows the two limit angular securing positions of the bent section 36 and the shaft 28 with respect to the generally concave blade 44', with the largest angle limit position shown in dashed lines. The angular position A between the two bent sections 36 and 36' is also shown. It can be clearly appreciated here the particular design of the bent section 36. The lower end 38 of the bent section 36 is preferably substantially vertical and slightly curved in the opposite direction as to better assume the upper part of the back 42 of the blade 44', while its upper extremity is curved to be aligned with the shaft 28 of the shovel 20. This particular system is quite unique and gives a positioning, at close proximity of the blade 44', of the shaft 28 being almost parallel to the plane of the blade 44'. This allows the vertical elevation of the handle 22 of the device 20 to be higher, which eases the uses of the shovel 20 for a taller user U' (shown on FIG. 3). Similarly, the hands of the user U may remain at a high vertical position, preferably at a level of the hips or above, notwithstanding the use being made of the shovel 20 compared to more traditional shovels and does not require the user U to bend as much while using the shovel 20 to remove snow S, hence increasing the ergonomic use and the security of the user U. Finally, this view also shows a different perspective on the attachment member 40.

The above mentioned explanations are furthermore demonstrated on FIG. 3 where two users U and U' of different heightsrespectively are using the shovel 20 to push snow S with a different angular position A and A'respectively adjusted to their height white both users U and U' are keeping the blade 44 in the same angled position relatively to the ground surface G. None of both users U or U' must bend more than the other. It shall be readily understood. by one skilled in the art that the shovel 20 could be used by one unique user U in different fashion and keep the handle at essentially a same vertical height while changing the angular position A which will affect the position of the blade 44 relative to the ground surface G. This could be convenient to alternatively push, clear or shovel the snow S. At the same time, the shovel 20 keeps a wider versatility towards users U of a varying height. Note that on FIG. 3 the angle shown for the T-shaped grip 24 is slightly distorted or does not represent a realistic perspective view, but this was done to show the preferred user's. hands position on the preferably slightly inclined, for improved comfort by forcing a natural angular orientation of the wrists, top transverse bar 26 of the T-shaped grip 24 when using the shovel 20.

Although embodiments have been described herein with some particularity and details, many modifications and variations of the preferred embodiment are possible without deviating from the scope of the present invention.

I claim:

1. A snow shovel comprising a shaft having a handle member at a first upper extremity and a downwardly oriented bent section at a second lower extremity and defining a substantially vertical plane, a generally concave blade member pivotally mounted at said second extremity of said shaft around an horizontal axis perpendicular to said vertical plane, a securing member providing a plurality of securing positions of said bent section of said shaft to said blade member into different relative angular positions, thereby adjusting a vertical position of said handle member relative to said blade member, said bent section having a lower end essentially vertically oriented and curved to substantially assume a shape of said concave blade member.

2. A snow shovel as defined in claim 1, further comprising an attachment member to pivotally secure said blade member to said lower end of said bent section at a pivot axis.

3. A snow shovel as defined in claim 2, wherein said securing member includes an arcuate member rigidly secured at one end to said blade member, said arcuate member being centered around said pivot axis of said attachment member.

4. A snow shovel as defined in claim 3, wherein said arcuate member includes a pair of parallel arcuate strips rigidly secured at one end to said blade member, said two arcuate strips slidably receiving said lower end of said bent section therebetween and having a plurality of symmetrical perforations therealong, said bent section of said shaft having a transverse through hole consecutively aligning with a pair of said symmetrical perforations under pivotal movement of said attachment member, and a locking pin simultaneously releasably engaging into said transverse hole and one of said pair of symmetrical perforations corresponding to one of said securing positions.

5. A snow shovel as defined in claim 4, wherein said locking pin includes a clamping member to releasably secure the same in locking position.

6. A snow shovel as defined in claim 5, wherein said clamping member is an upper resilient hook clamping to said bent section and maintaining said locking pin in said locking position.

7. A snow shovel as defined in claim 6, wherein said handle member is a T-shaped grip with a top transverse bar slightly inclined toward said blade member, thereby providing a comfortable position of a user's hands.

8. A snow shovel as defined in claim 1, wherein said handle member is a T-shaped grip with a top transverse bar slightly inclined toward said blade member, thereby providing a comfortable position of a user's hands.

* * * * *